United States Patent [19]

Rau et al.

[11] Patent Number: 4,955,478

[45] Date of Patent: Sep. 11, 1990

[54] FLIP-TOP DRILL-BIT STORAGE AND DISPLAY BOX

[75] Inventors: Georg Rau, Giengen-Hohenhemmingen; Werner Hitzler, Herbrechtingen; Gerhard Riess, Bachhagel-Burghagel, all of Fed. Rep. of Germany

[73] Assignee: Firma Georg Knoblauch, Brenz, Fed. Rep. of Germany

[21] Appl. No.: 431,609

[22] Filed: Nov. 3, 1989

[30] Foreign Application Priority Data

Nov. 8, 1988 [DE] Fed. Rep. of Germany ..... 3837829

[51] Int. Cl.[5] ..... B65D 85/28

[52] U.S. Cl. ..... 206/379; 206/372; 211/69; 220/342; 16/221

[58] Field of Search ..... 206/349, 372, 379, 45.18; 220/338, 342, 343; 211/69; 16/297, 319, 374, 221

[56] References Cited

U.S. PATENT DOCUMENTS

| | | | |
|---|---|---|---|
| 2,765,949 | 10/1956 | Hillman | 220/338 |
| 3,074,539 | 1/1963 | Rogovin | 206/379 |
| 4,029,234 | 6/1977 | Johnson, Jr. et al. | 220/338 |
| 4,458,826 | 7/1984 | Mu-Jung | 220/338 |
| 4,512,467 | 4/1985 | Knoblauch | 206/379 |
| 4,598,824 | 7/1986 | Long et al. | 206/45.18 |
| 4,660,719 | 4/1987 | Peterson et al. | 206/379 |
| 4,706,813 | 11/1987 | Schneider et al. | 220/338 |

FOREIGN PATENT DOCUMENTS

| | | | |
|---|---|---|---|
| 2446504 | 2/1976 | Fed. Rep. of Germany | 206/379 |
| 2461766 | 5/1982 | Fed. Rep. of Germany . | |
| 1551250 | 8/1979 | United Kingdom | 206/379 |

*Primary Examiner*—David T. Fidei

*Attorney, Agent, or Firm*—Herbert Dubno; Andrew Wilford

[57] ABSTRACT

A storage/display box for elongated objects has a body having a pair of generally parallel side walls spaced apart along an axis, a cover pivoted on the body and engageable therewith to close same, and an insert engageable within the body and beneath the cover. This insert is connected to the cover for pivoting therewith and is adapted to hold the objects. A respective body tab projects from each of the side walls generally at the axis and is formed with an inner part of part-cylindrical shape, centered on the axis and having an inner end connected to the respective side wall and an outer end and an outer part projecting generally perpendicular to and crossing the axis. The inner part forms between its ends a part-cylindrical seat. A respective insert tab formed on the insert adjacent each side wall at the axis has a part-cylindrical outer edge complementary to and fitting within the inner part of the respective body tab. A pivot axle passes through each body tab and the respective insert tab at the axis. Thus on pivoting of the insert on the body each outer edge rides on the seat of the respective inner part.

10 Claims, 5 Drawing Sheets

FLIP-TOP DRILL-BIT STORAGE AND DISPLAY BOX

FIELD OF THE INVENTION

The present invention relates to a storage and display case or box for elongated objects. More particularly this invention concerns such a box intended to hold an array of drill bits in order.

BACKGROUND OF THE INVENTION

A standard display/storage box for drill bits or the like has an open-top base having a pair of side walls and a pair of end walls bridging them. A cover is hinged to one of the end walls and one or more inserts are pivoted on the side walls and connected to the cover so that when same is pivoted up to open the box, the inserts rise up and display the items they hold. When the items are drill bits the inserts are formed with graduated holes into which they fit so that the desired size can easily be found and selected.

In German patent No. 2,461,766 filed Dec. 28, 1974 by Karl Sautter (citing U.S. Pat. Nos. 2,269,637, 2,775,342, 3,018,876, and 3,074,539) such an arrangement is shown wherein the pivot between the inserts and the side walls is constituted by a rivet or bolt. The small diameter of this pivot element is heavily loaded when, for instance, it must support several inserts filled with relatively heavy twist-drill bits, so that such an arrangement has a regrettably short service life.

OBJECTS OF THE INVENTION

It is therefore an object of the present invention to provide an improved display/storage box.

Another object is the provision of such an improved display/storage box which overcomes the above-given disadvantages, that is which is built to have a long service life.

SUMMARY OF THE INVENTION

A storage/display box for elongated objects according to this invention has a body having a pair of generally parallel side walls spaced apart along an axis, a cover pivoted on the body and engageable therewith to close same, and an insert engageable within the body and beneath the cover. This insert is connected to the cover for pivoting therewith and is adapted to hold the objects. A respective body tab projects from each of the side walls generally at the axis and is formed with an inner part of part-cylindrical shape, centered on the axis and having an inner end connected to the respective side wall and an outer end and an outer part projecting generally perpendicular to and crossing the axis. The inner part forms between its ends a part-cylindrical seat. A respective insert tab formed on the insert adjacent each side wall at the axis has a part-cylindrical outer edge complementary to and fitting within the inner part of the respective body tab. A pivot axle passes through each body tab and the respective insert tab at the axis. Thus on pivoting of the insert on the body each outer edge rides on the seat of the respective inner part.

With this arrangement, therefore, the entire load of the insert and its load is not borne solely by the pivot, but is also carried by the interfit of the insert lug in the side-wall lug. This spreads the load out so that substantial weight can be carried with substantially less wear.

According to a feature of this invention the seat and outer edge have relative to the axis an arcuate extent of at most 180°, so that the insert tab can move into and out of the sidewall seat. In addition the outer end of each body tab is a part circular disk and the body tabs are punched out of and unitary with the respective side walls.

The axle can be formed by respective rivets each traversing the respective insert tab and outer end or by a pin projecting through the insert tabs and outer ends. It can also be formed by respective lugs bent axially out of each outer end at the axis. These lugs are each formed with a camming edge inclined downward away from the cover.

In accordance with a further feature of this invention each insert tab is formed with a radially outwardly extending projection which forms a stop for the edge of the respective inner part. Each insert tab can in fact form a plurality of such stops angularly offset from one another relative to the axis for fanning out a plurality of inserts. Furthermore each side wall is formed axially offset from the respective outer part with a stop lug projecting radially of the axis inward of the respective inner part so that each insert tab is captured axially between the respective outer part and the respective stop lug. Each such stop lug is unitary with and punched out of the respective side wall.

DESCRIPTION OF THE DRAWING

The above and other objects, features, and advantages will become more readily apparent from the following, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 2:
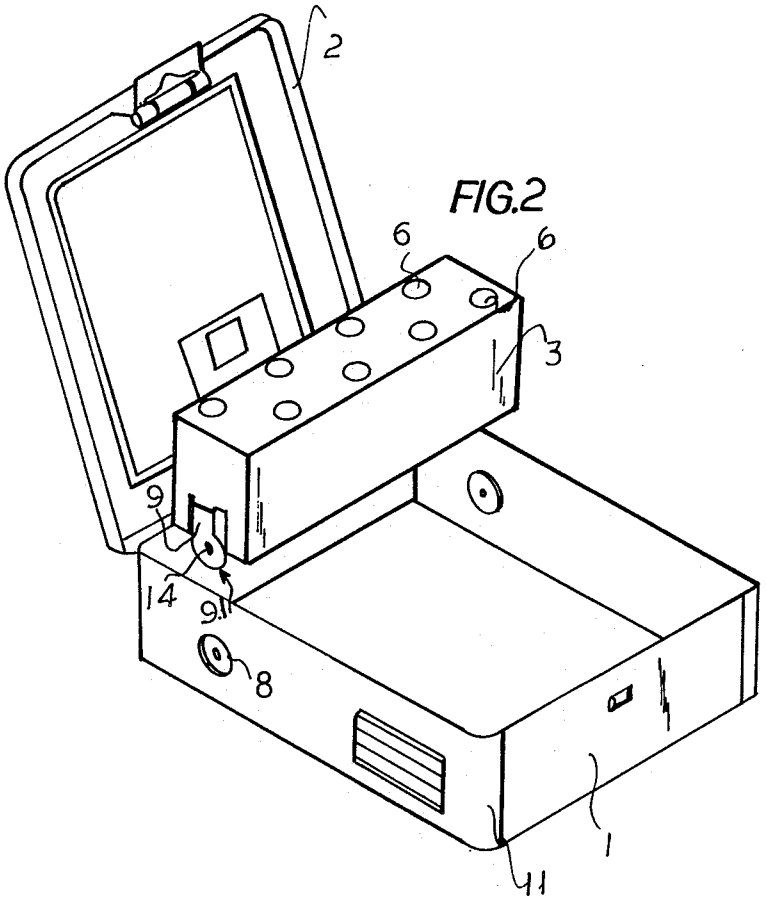
FIG. 2 is a partly exploded view of the box of FIG. 1.
Figure 1:
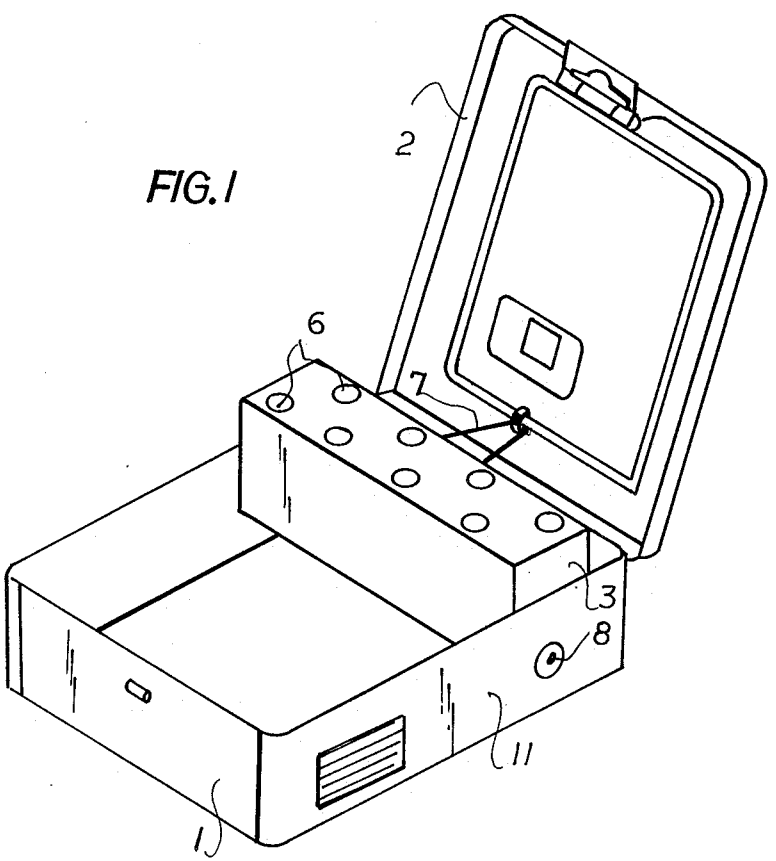
FIG. 1 is a perspective view of a display/storage box according to this invention.
Figure 3:
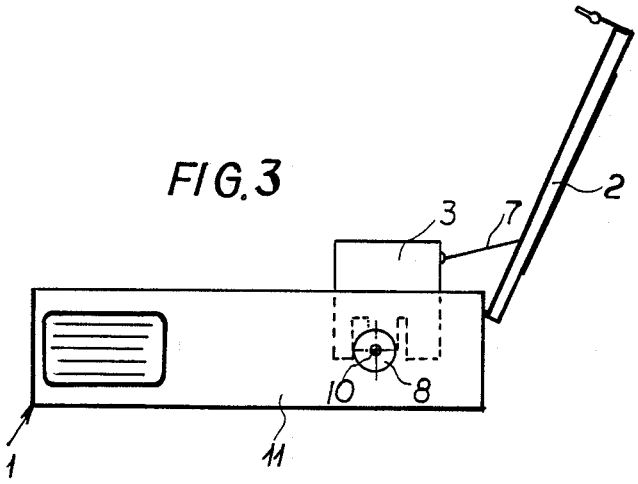
FIG. 3 is a side view of the box of FIG. 1.
Figure 4:
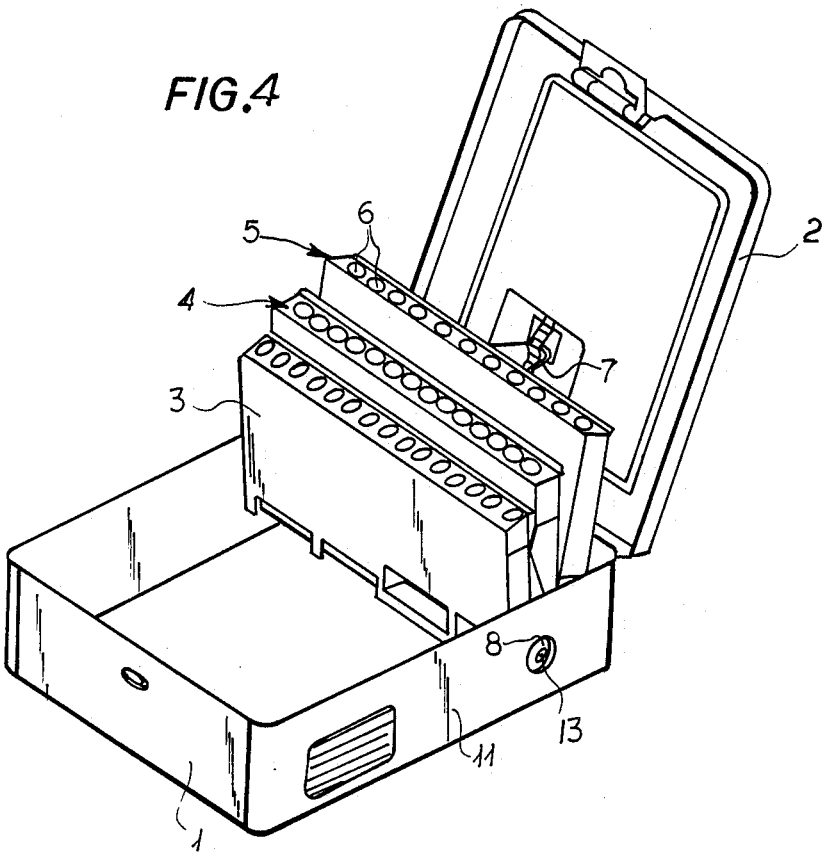
FIG. 4 is a perspective view of a second display/storage box according to this invention.
Figure 5:
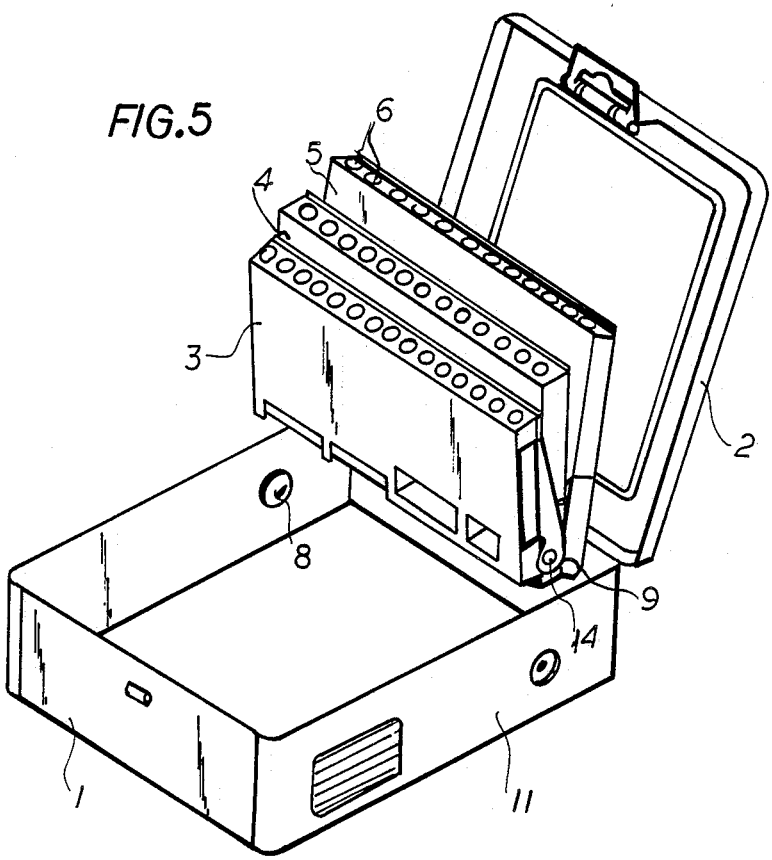
FIG. 5 is a partly exploded view of the box of FIG. 2.
Figure 6:
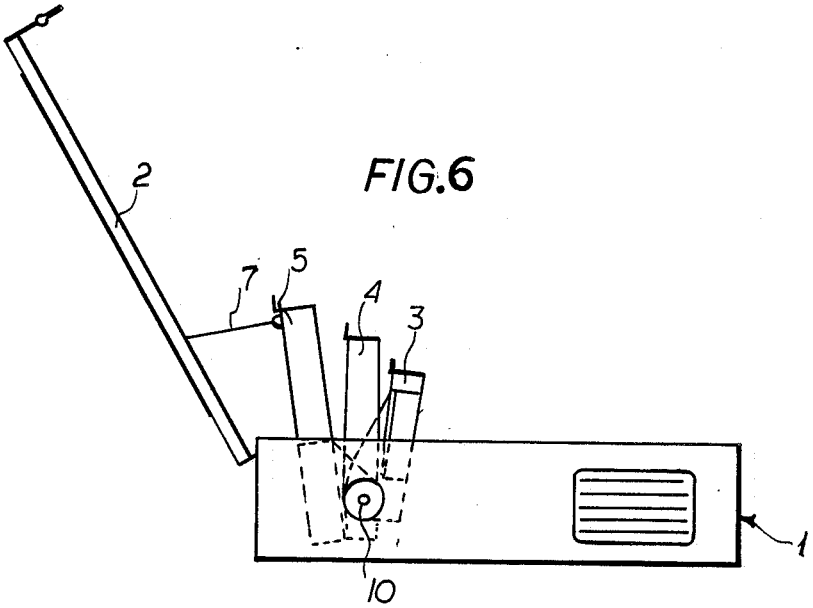
FIG. 6 is a side view of the box of FIG. 2.

As seen in FIGS. 1 through 6 a storage-display box has a parallepipedal body 1 closable by a lid or cover 2 and containing either a single insert 3 as shown in FIGS. 1–3 or three inserts 3, 4, and 5 as seen in FIGS. 4, 5, and 6. A connector 7 is tied between the lid 2 and the inserts to erect them and display items held in them, for instance drill bits seated in holes 6. The body 1 has a pair of side walls 11 each formed with a pivot tab 8 and the insert 3 is similarly formed with complementary pivot tabs 9 that fit with the tabs 8 for relative pivoting of the insert 3 and body 1 about an axis 10 traversing the tabs 8 and 9 and perpendicular to the side walls 11.

Figure 7:
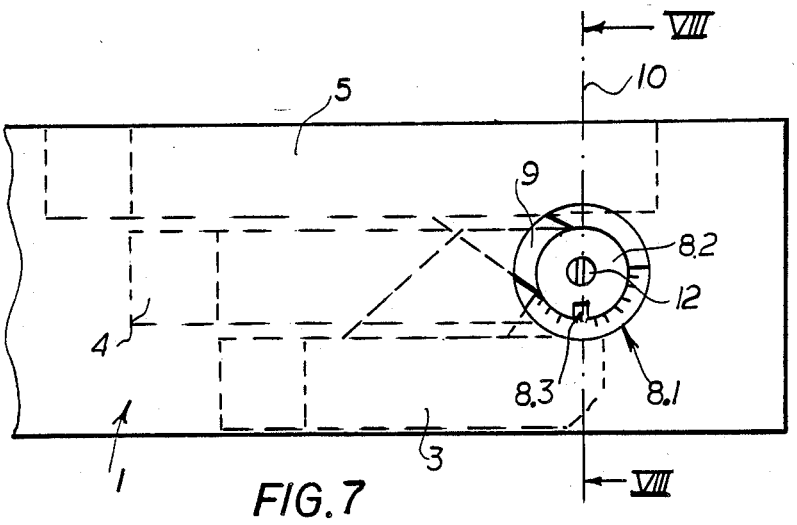
FIG. 7 is a large-scale view illustrating the pivot of the box of FIG. 2.
Figure 8:
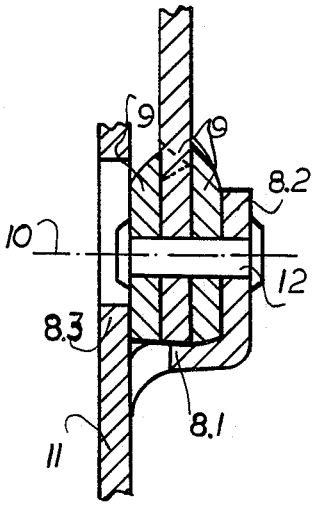
FIG. 8 is a section taken along line VIII—VIII of FIG. 7.

As also shown in FIGS. 7 and 8 each tab 8 is punched out of the respective side wall 11 and is unitarily formed with an inner part 8.1 forming a semicylinder having an inner end connected to the respective side wall 11 and an outer end from which extends a part-circular disk 8.2 spaced from but parallel to the respective side wall 11. In addition a stop lug 8.3 is punched out of the side wall 11 and extends radially of the axis 10 inward past the respective inner part 8.1 and parallel to the outer part 8.2. The inner part 8.1 therefore forms a part-cylindrical seat centered on the axis 10, extending over somewhat less than 180° about the axis 10, and bounded axially on one side by the outer part 8.2 and on the other side by the lug 8.3.

Each lug 9 is formed with a central pivot hole 14 (FIG. 2) and with a part-circular outer edge 9.1 that fits complementarily within the seat formed by the respective inner part 8.1. Thus when pins or rivets such as shown at 12 in FIG. 8 interconnect the lugs 8 and 9 at the axis 10, the lugs 9 will actually be in part supported at these edges 9.1 on the lug parts 8.1, thereby spreading the load out. In this manner even if the insert 3 is loaded with relatively heavy drill bits, the load will not all be carried by the pivot 12.

Figure 9:
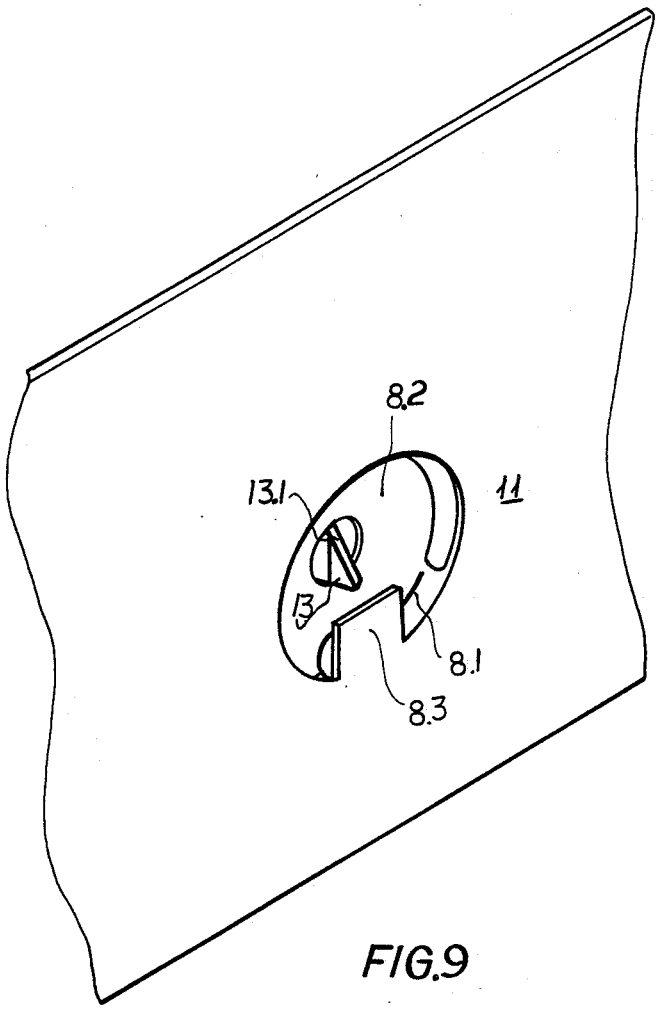
FIG. 9 is a large-scale perspective view of a variation on the system of this invention.

It is also possible as seen in FIG. 9 for the outer lug part 8.2 to be bent in at 13 to form a pivot lug replacing the respective rivet 12. This lug 13 has an edge 13.1 that is inclined downward and outward so that the insert 3 can be fitted to it by being snapped into place, that is with temporary elastic deformation of the parts which will lock together once aligned.

I claim:

1. A storage/display box for elongated objects, the box comprising:

a body having a pair of generally parallel side walls spaced apart along an axis;

a cover pivoted on the body and engageable therewith to close same;

an insert engageable within the body and beneath the cover, the insert being connected to the cover for pivoting therewith and adapted to hold the objects;

a respective body tab projecting from each of the side walls generally at the axis and formed with an inner part of part-cylindrical shape, centered on the axis and having an inner end connected to the respective side wall and an outer end, the inner part forming between its ends a part-cylindrical seat, and an outer part projecting generally perpendicular to and crossing the axis;

a respective insert tab formed on the insert adjacent each side wall at the axis, each insert tab having a part-cylindrical outer edge complementary to and fitting within the inner part of the respective body tab; and a pivot axle passing through each body tab and the respective insert tab at the axis, whereby on pivoting of the insert on the body each outer edge rides on the seat of the respective inner part.

2. The storage/display box defined in claim 1 wherein the seat and outer edge have relative to the axis an arcuate extent of at most 180°.

3. The storage/display box defined in claim 2 wherein the outer end of each body tab is a part circular disk.

4. The storage/display box defined in claim 3 wherein the body tabs are punched out of and unitary with the respective side walls.

5. The storage/display box defined in claim 1 wherein the axle is formed by respective rivets each traversing the respective insert tab and outer end.

6. The storage/display box defined in claim 1 wherein the axle is formed by a pin projecting through the insert tabs and outer ends.

7. The storage/display box defined in claim 1 wherein the pivot is formed by respective lugs bent axially out of each outer end at the axis.

8. The storage/display box defined in claim 7 wherein the lugs are each formed with a camming edge inclined downward away from the cover.

9. The storage/display box defined in claim 1 wherein each side wall is formed axially offset from the respective outer part with a stop lug projecting radially of the axis inward of the respective inner part, each insert tab being captured axially between the respective outer part and the respective stop lug.

10. The storage/display box defined in claim 9 wherein each stop lug is unitary with and punched out of the respective side wall.

* * * * *